US006015358A

United States Patent [19]

Spector

[11] Patent Number: 6,015,358

[45] Date of Patent: Jan. 18, 2000

[54] BALL HAVING STICKER APPLIED THERETO

[76] Inventor: Donald Spector, 380 Mountain Rd., Union City, N.J. 07080

[21] Appl. No.: 09/164,995

[22] Filed: Oct. 1, 1998

[51] Int. Cl.[7] ..... A63B 39/00

[52] U.S. Cl. ..... 473/595; 473/569; 446/100

[58] Field of Search ..... 473/595, 596, 473/569, 614, 600, 601; 40/327; 446/99, 100, 901

[56] References Cited

U.S. PATENT DOCUMENTS

| | | | |
|---|---|---|---|
| 2,324,277 | 7/1943 | Casey et al. | 40/327 |
| 2,960,794 | 11/1960 | Johns | 473/614 X |
| 3,811,211 | 5/1974 | Morgan | 40/327 X |
| 4,979,924 | 12/1990 | Manger | 446/100 |
| 5,091,833 | 2/1992 | Paniaguas et al. | 446/100 X |
| 5,503,699 | 4/1996 | Ratner et al. | 473/614 X |
| 5,511,782 | 4/1996 | Maley | 473/569 |
| 5,551,687 | 9/1996 | Krull | 446/901 X |

FOREIGN PATENT DOCUMENTS

| | | | |
|---|---|---|---|
| 418730 | 3/1991 | European Pat. Off. | 446/100 |
| 2559676 | 8/1985 | France | 446/100 |
| 466147 | 5/1937 | United Kingdom | 446/100 |

*Primary Examiner*—Raleigh W. Chiu
*Attorney, Agent, or Firm*—Michael Ebert

[57] ABSTRACT

A molded plastic play ball having the appearance of a humanoid head. Formed on the surface on the ball at sites corresponding to respective facial features of the head, such as the eyes and a nose, are flat depressions that merge with the contours of the ball. Adhered to these flat depressions are stickers having color-printed thereon facial features appropriate to the sites. The appearance of the humanoid head is determined by the stickers selected by the player and applied to the depressions, which features may be altered by replacing some or all of the stickers with different stickers.

10 Claims, 1 Drawing Sheet

BALL HAVING STICKER APPLIED THERETO

BACKGROUND OF THE INVENTION

1. Field of Invention

This invention relates generally to a play ball having the appearance of a humanoid head, and more particularly to a play ball of this type whose facial features are selected and applied to the ball by the player.

2. Status of Prior Art

A play ball is conventionally made by a blow molding process in which air or another gas is introduced into a plastic parison to cause it to expand against a mold whose size and shape define the ball. Thus in blow molding a spherical ball, the mold is spherical, whereas an elliptical mold is used when blow molding a ball having a football shape.

The Casey et al. U.S. Pat. No. 2,324,277 discloses a rubber play ball blow molded to have a generally spherical form. However, the mold for this purpose acts to create recesses and projections on the surface of the ball to simulate the eyes, nose, mouth and ears of the head of a humanoid figure, such as the so-called Man-in-the-Moon. The surface irregularities of the Casey et al. ball do not interfere with the ability to bounce, kick or throw the ball.

The term "kick" has either a literal or figurative meaning, and in some instances the two meanings are merged. Thus when a ball is kicked, it is literally struck, for the kicker's foot then makes contact with the ball. But if you kick someone around, you are then treating him badly, not actually striking him. Thus President Nixon is remembered for his remark to the press that they would not have him around to kick anymore.

When however one kicks someone who is down, this combines a physical act with a deliberate insult, for the individual who is down is unable to retaliate and the act of kicking him is an expression of contempt.

Perhaps the earliest example of a kick that is both a physical act and an insult is in the soccer game invented by the Inca Indians of South America who used as a soccer ball a skull separated from an enemy's body. A player in kicking this skull, thereby insulted the spirit of the enemy.

The drawback of the Casey et al. ball is that its facial features are not selected by the player but are predetermined by the mold in which the ball is formed. Moreover, the features all have the color of the rubber from which the ball is made. Hence in the Casey et al. ball one does not have say red lips, blue eyes and black hair, for the facial features all share the same color and therefore are not realistic.

SUMMARY OF INVENTION

In view of the foregoing, the main object of this invention is to provide a bounceable, throwable and kickable play ball that has the appearance of a humanoid head whose facial features are selected by the player.

More particularly, an object of the invention is to provide a play ball of the above type in which the contoured surface of the ball has flat depressions thereon at sites corresponding to the facial features of the head, stickers being applied to these depressions having the desired facial features printed thereon.

A significant advantage of a play ball in accordance with the invention is that the player can create a humanoid head that resembles the head of a figure which the player wishes to kick around and insult so that the player receives a special gratification in playing with the ball. Thus the player can create for this purpose the head of an unpopular political figure.

Briefly stated, these objects are accomplished by a molded plastic play ball having the appearance of a humanoid head. Formed on the surface on the ball at sites corresponding to respective facial features of the head, such as the eyes and a nose are flat depressions that merge with the contours of the ball. Adhered to these flat depressions are stickers having color-printed thereon facial features appropriate to the sites.

The appearance of the humanoid head is determined by the stickers selected by the player and applied to the depressions. These features may be altered by replacing some or all of the stickers with different stickers.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
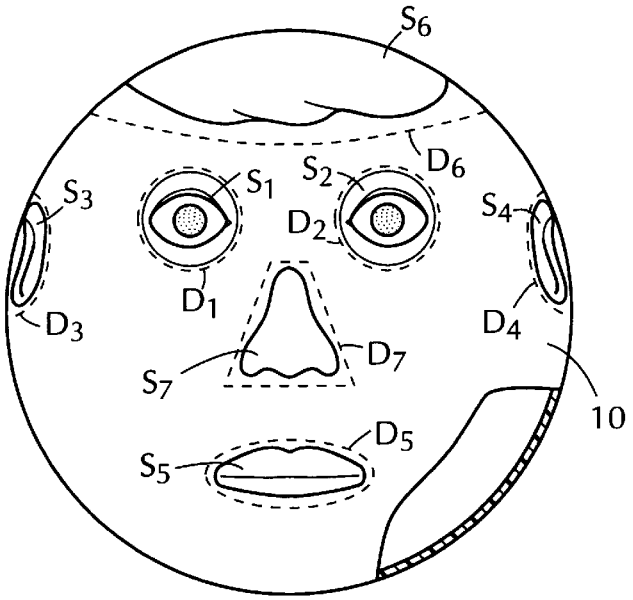
FIG. 1 shows a generally spherical sticker ball in accordance with the invention having the appearance of a humanoid head.
Figure 2:
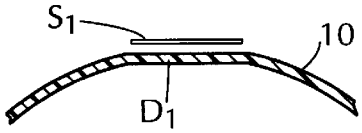
FIG. 2 illustrates one of the flat depressions on the surface of the ball to which a sticker is applied.

Referring now to FIG. 1, shown therein is a blow molded, generally spherical ball 10 formed of elastomeric plastic material, such as polyurethane having a hollow core. This pneumatic ball which preferably has the same size as a soccer ball is throwable, bounceable and kickable. Since the ball has the appearance of a humanoid head whose facial features are selected by the player, the fact that it is kickable is of particular value, for then the player can kick and thereby insult the head of a figure that he abhors.

Ball 10 does not have a perfect spherical shape, for formed on the surface of the ball are flat depressions which are placed at sites corresponding to the facial features of a humanoid head and merge with the contours of the ball.

Thus depressions $D_1$ and $D_2$ are at the sites of a pair of eyes, depressions $D_3$ and $D_4$ are at the sites of a pair of ears, and depression $D_5$ is placed at of the mouth. Depression $D_6$ is at a hai site and depression $D_7$ locates the nose. In practice, there may also be flat depressions at sites of the eyebrows and cheeks.

Applied to these depressions are stickers having color-printed thereon appropriate facial features. Each sticker may be formed of polyvinyl or other plastic film, such as that used in Scotch tape, having its underside coated with a layer of pressure-sensitive adhesive.

Thus applied to facial depressions $D_1$ and $D_2$ and conforming thereto are stickers $S_1$ and $S_2$ having eyes printed thereon in a particular color and shape. Stickers $S_3$ and $S_4$ applied to flat depressions $D_3$ and $D_4$ have ears printed thereon. And stickers $S_5$, $S_6$ and $S_7$ applied respectively to depressions $D_5$, $D_6$ and $D_7$ define the mouth, hair and nose of the head.

The flat depressions are shaped to generally conform to the shape of the facial features to be applied thereto so that when a sticker is adhered to a depression, the sticker which has the same shape conceals the depression.

Hence the actual appearance of the human head created by the player depends on the nature of the facial features applied to the various flat depressions. Thus the eyes may be slanted or oval, the mouth may be smiling or scowling, the ears may be delicate or gross, and the hair may be gray or black.

Figure 3:
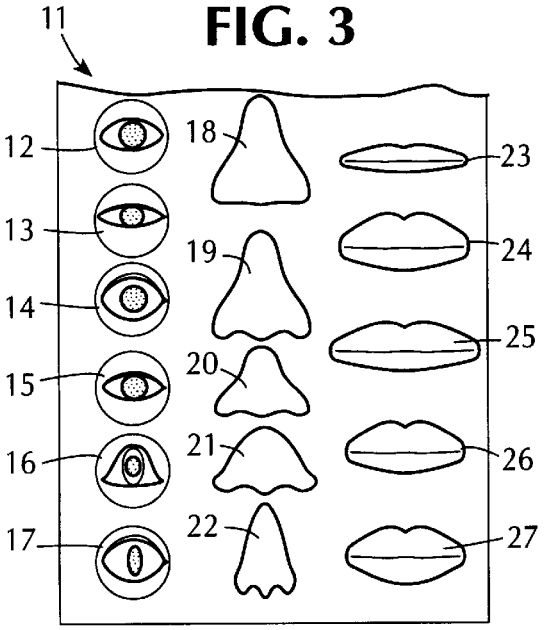
FIG. 3 illustrates a supply sheet carrying a variety of stickers.

In order to make available to the player a broad range of different facial features so that he can create a humanoid head having a desired appearance, as shown in FIG. 3 the player is provided with supply sheets 11, each having adhered thereto a plurality of peel off stickers, such as stickers 12 to 17 having eyes printed therein in different shapes and colors. Also attached to sheet 11 are stickers 18 to 20 having noses printed thereon in different shapes and colors, as well as stickers 23 to 27 having mouths of different shapes printed thereon.

By providing the player with supply sheets creating a plentiful bank of different facial features, the player can select from this bank whatever stickers he needs to create a humanoid head having a desired appearance.

Figure 4:
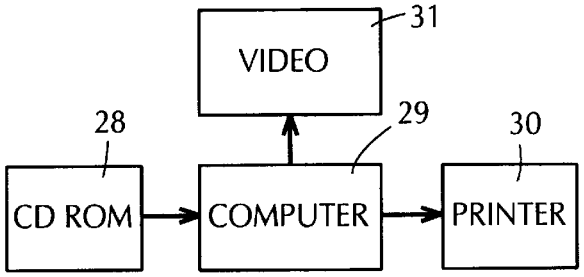
FIG. 4 illustrates a computer system for generating stickers to be applied to the ball.

This bank of different facial features need not be preprinted as is necessary with the supply sheet 11 in FIG. 3, for as shown in FIG. 4, the stickers may be computer generated. For this purpose, the graphics of a large variety of facial features may be digitally stored in a CD ROM 28. A feature selected by the player from CD ROM 28 is downloaded into a computer 29 so that it can be seen on the video terminal 31 of the computer.

If the feature shown is acceptable, it is then fed into an associated printer 30 where it is printed on a sheet of plastic film having a layer of pressure-sensitive adhesive coated on its underside. Hence by means of the arrangement shown in FIG. 4 one can create supply sheets, similar to sheet 11 in FIG. 3. However, in FIG. 3 the stickers can each be peeled off the supply sheet, whereas in the FIG. 4 arrangement, the printed facial features would have to be cut off the sheet.

Figure 5:
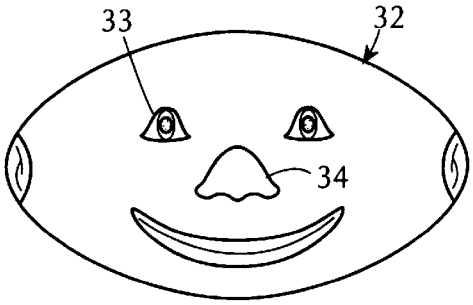
FIG. 5 shows a football-shaped sticker ball in accordance with the invention.

The invention is not limited to spherically-shaped balls, for as shown in FIG. 5, the ball 32 may be blow-molded into a football shape provided with flat depressions to which stickers are applied to define the eyes 33, the nose 34 and the other features of the humanoid head.

And it is not essential to the invention that the ball be blow-molded, for the ball may be of solid construction or fabricated by other ball-making techniques, provided that the ball so produced has flat depressions to accommodate the stickers. And the adhesive stickers are preferably of the peel off type, so that a sticker applied to a depression can be peeled off and replaced by another sticker having a facial feature in a different form. However, in practice, the replacement sticker can, be adhered over a sticker adhered to a depression.

While there has been shown and described a preferred embodiment of a ball having stickers applied thereto in accordance with the invention, it will be appreciated that many changes and modifications may be made therein without, however, departing from the essential spirit thereof.

I claim:

1. A play ball having the appearance of a humanoid head comprising:

A. a ball molded of elastomeric material having a contoured surface on which is formed flat depressions that merge with this surface, said flat depressions being placed at sites corresponding to facial features of the humanoid head; and B. stickers adhesively applied to the respective depressions having printed thereon facial features appropriate to the sites.

2. A play ball as set forth in claim 1, in which said facial features include eyes, ears, a mouth and a nose, and said features are color printed on respective stickers.

3. A play ball as set forth in claim 1, in which said stickers each have an undercoat of a pressure-sensitive adhesive.

4. A play ball as set forth in claim 3, in which said stickers are peel-off stickers and therefore can readily be replaced with other stickers to create a humanoid figure having a different appearance.

5. A play ball as set forth in claim 1, in which the play ball is blow molded and has a hollow core.

6. A play ball as set forth in claim 1, in which the play ball has a spherical shape.

7. A playball as set forth in claim 6, in which the playball has about the size of a soccer ball.

8. A play ball as set forth in claim 5, in which the play ball has a football shape.

9. A play ball as set forth in claim 1, in which the stickers applied to the ball are derived from a bank of stickers having a large variety of facial features.

10. A play ball as set forth in claim 9, in which the bank of stickers are derived from a CD ROM in which is digitally stored the graphics of a variety of facial features whereby a player can down load a feature selected from the ROM into a computer which prints out the selected feature.

* * * * *